United States Patent [19]

Whitehouse

[11] 4,356,746

[45] Nov. 2, 1982

[54] APPARATUS FOR PORTIONING MEAT

[75] Inventor: John A. Whitehouse, Norwich, England

[73] Assignee: AEW Engineering Co., Ltd., Norwich, England

[21] Appl. No.: 164,762

[22] Filed: Jun. 30, 1980

[51] Int. Cl.[3] ..... B26D 7/06; B26D 7/22

[52] U.S. Cl. ..... 83/411 A; 83/701; 83/733; 83/803; 83/813

[58] Field of Search ..... 83/410, 411 R, 411 A, 83/439, 703, 813, 814, 417, 733, 648, 803, 808, 701, 546, 356.1, 479

[56] References Cited

U.S. PATENT DOCUMENTS

| | | | |
|---|---|---|---|
| 1,407,759 | 2/1922 | Knox | 83/441 A X |
| 1,769,594 | 7/1930 | Nagy | 83/411 A |
| 2,228,974 | 1/1941 | Portwood | 83/417 X |
| 3,782,230 | 1/1974 | Bettcher | 83/411 A X |
| 3,972,256 | 8/1976 | Ross | 83/411 A X |
| 4,050,339 | 9/1977 | Soleri | 83/411 A X |
| 4,062,262 | 12/1977 | Odell | 83/411 A X |

FOREIGN PATENT DOCUMENTS

| | | | |
|---|---|---|---|
| 1279262 | 11/1961 | France | 83/411 A |
| 1057052 | 2/1967 | United Kingdom . | |

*Primary Examiner*—Stephen G. Kunin
*Assistant Examiner*—Robert P. Olszewski
*Attorney, Agent, or Firm*—Howard H. Darbo

[57] ABSTRACT

The apparatus comprises a horizontally arranged bandsaw and one or more rotary meat holders arranged to feed primal cuts of meat downwards and onto the bandsaw to be cut into portions. A depth stop, which may be adjustable, determines the thickness of the cut portion. In a preferred form, the bandsaw is substantially totally enclosed and two meat holders are provided, one of which may be loaded while meat in the other is being portioned.

5 Claims, 3 Drawing Figures

APPARATUS FOR PORTIONING MEAT

This invention relates to apparatus for portioning meat and like comestible articles.

In the preparation of meat for consumption, it is usual to separate the carcass into a number of primal cuts and subsequently divide the primal cuts into portions. This portioning has traditionally been effected by hand using knives, saws and cleavers, but in recent years attention has been directed to improving the productivity of the portioning operation in mass production meat processing.

Automatic machines are known in which a primal cut resting against a stop is moved in a rotary path into contact with a powered rotating cleaving blade. The severed portion is removed, e.g. by gravity, and the primal cut advanced against the stop for the process to be repeated. An example of such a machine is shown in British Pat. No. 1,057,052. Such machines do not give an entirely satisfactory product. The cleaving blade is thicker in its centre than at its edge, and this produces a curved portion. Secondly, when forming chops and similar "bone-in" portions, the cleaver tends to smash the bone, causing bone fragments to be found in the meat. Both of these factors are unpopular with consumers.

It is also known to make use of a conventional bandsaw (i.e. with a horizontal worktable and a blade band having a vertical operative portion) in cutting chops and the like, the operator manoeuvering the primal cut to and fro onto the blade band. This is dangerous for the operator since it is impossible to fence the blade, and the rate of production is not very high.

It is therefore an object of the present invention to provide an improved apparatus for portioning meat. The invention also seeks to give good operator safety and productivity.

The invention accordingly provides apparatus for portioning meat, comprising a bandsaw arranged with a horizontal cutting flight, a meat holder positioned above said flight for rotation about a vertical axis, the meat holder being adapted to hold meat to be portioned substantially vertically at a position spaced from said axis, means for rotating the meat holder about said axis, and a depth stop below said flight, whereby the meat to be portioned is fed across said flight while resting on the depth stop by rotation of the meat holder.

An embodiment of the invention will now be described, by way of example, with reference to the accompanying drawings, in which.

Figure 1:
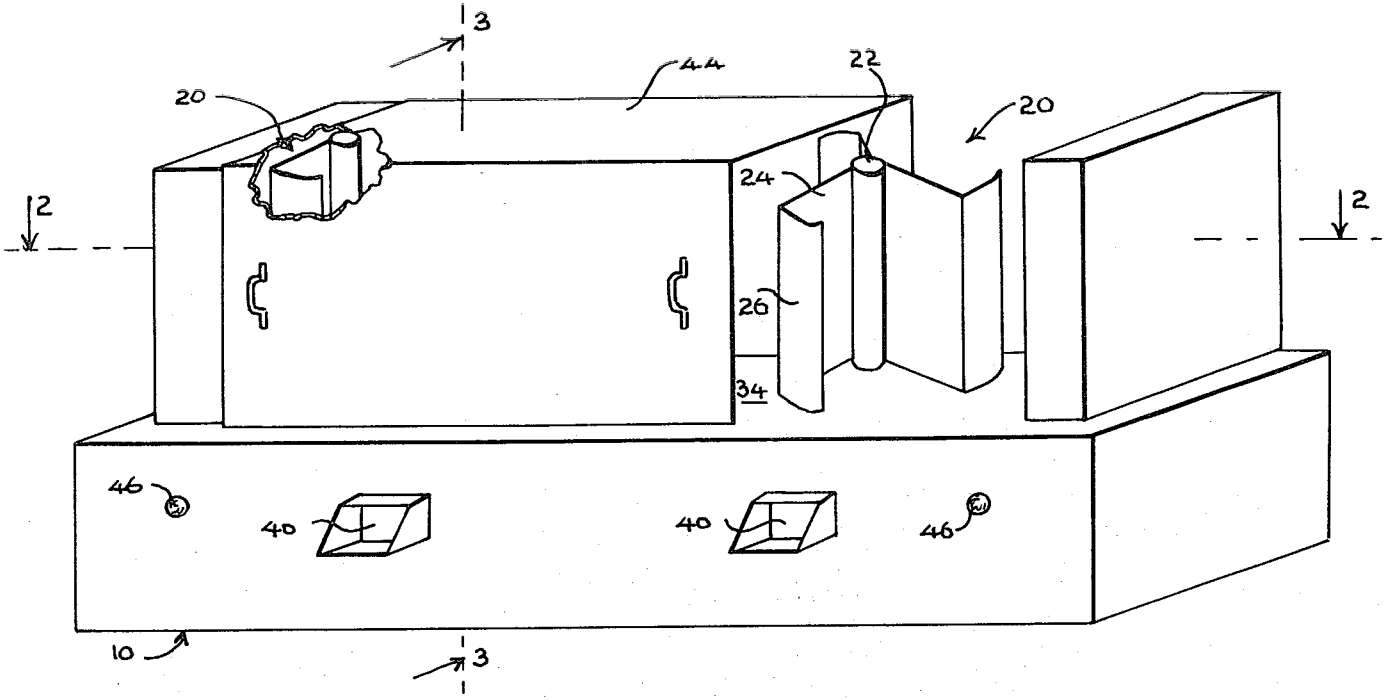
FIG. 1 is a perspective view of apparatus in accordance with the invention.

The apparatus includes a substantially closed base 10. Within the base 10 a bandsaw blade 12 is arranged horizontally, the blade 12 passing around pulleys 14 journalled in the base 10. One of the pulleys 14 is driven by an electric motor 16 via a belt drive 18.

Two meat cylinder assemblies 20 are mounted on top of the base 10. Each assembly 20 includes a central tubular portion 22 and radial plate members 24 which are bent to form circumferential wings 26. Each tubular portion 22 is received on a vertical shaft 28 and is drivingly coupled thereto by means (not shown) such as interengaging shoulders. The shafts 28 are driven by respective electric motors 30 via belt drives 32. The cylinder assemblies 20 may thus be rotated over the plate 34 forming the top surface of the base 10.

Under part of the path of movement of each of the cylinder assemblies 20, the plate 34 is formed with respective apertures 36. A depth stop in the form of a plate 38 is provided under each aperture 36. Although not shown in the drawings, each plate 38 is suitably adjustable in the vertical direction.

Figure 2:
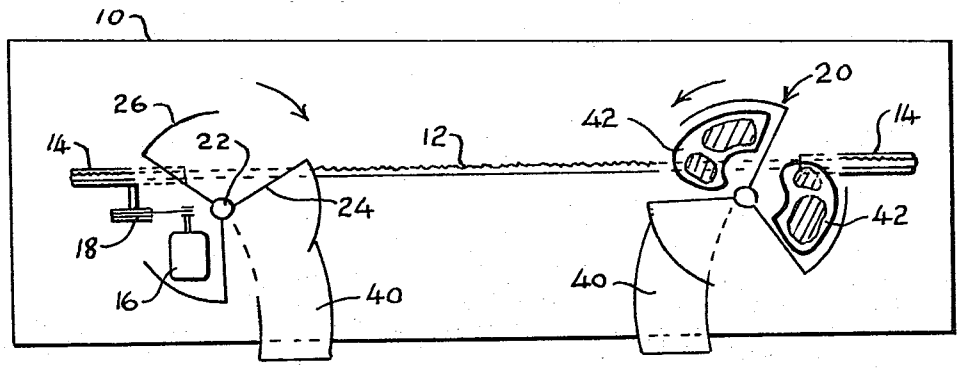
FIG. 2 is a diagrammatic plan view on the line 2—2 of FIG. 1.
Figure 3:
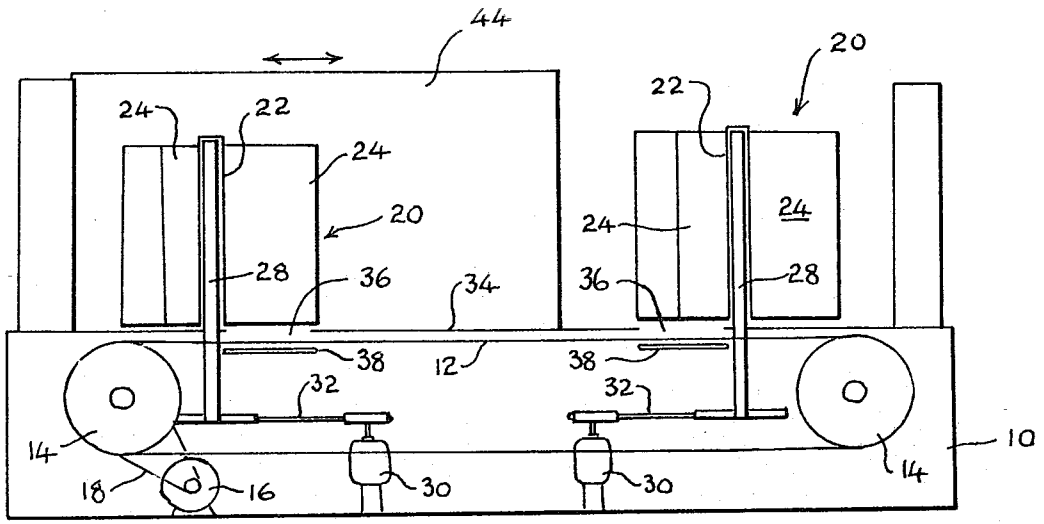
FIG. 3 is a diagrammatic elevation on the line 3—3 of FIG. 1.

As seen in FIG. 2, in use primal cuts 42 of meat are loaded into the cylinder assemblies 20. Each cut is held in the space defined by the central portion 22 and one of the radial plates 24 and wings 26. A greater or smaller number of such spaces may be provided to suit the size of the cuts being processed. As the assembly 20 rotates, the lower end of each cut in turn passes through the aperture 36 to a depth defined by the plate 38 and is moved by the rotation of the assembly 20 across the bandsaw blade 12 to sever a portion. The severed portion is delivered to the front of the apparatus by sliding under gravity down a chute 40.

The apparatus is conveniently operated by loading meat into one of the cylinder assemblies 20 while meat previously loaded into the other is being portioned. In this way a high rate of production is attained. A sliding cover 44 may be moved to cover the assembly 20 in operation.

Thus, in the condition illustrated in the figures, the left-hand assembly 20 is covered for shielding this assembly during operation, while the right-hand assembly is uncovered and so can be loaded with meat during operation of the left-hand assembly. After meat in the left-hand assembly has been positioned, the relevant motor 30 is stopped and the cover 44 is slid to a position in which it covers the right-hand assembly (now loaded with meat). The right-hand assembly is then operated while the now-uncovered left-hand assembly is loaded with meat. The arrangement thus permits high through put in safety.

Suitably, individual switches 46 are provided for the motors 30 driving the assemblies 20 to allow each of the latter to be halted while being loaded.

It will be appreciated that the apparatus has a high degree of safety since the bandsaw is virtually totally enclosed. The portions produced are flat and any bones therein are cleanly cut. The combination of a rotary meat holder with a bandsaw gives a high rate of production, which is further improved by the use of twin meat holders as described above.

It is of course possible to make modifications to the embodiment described within the scope of the appended claims. For example, a single electric motor may be used in conjunction with suitable mechanical transmission to drive the bandsaw and the cylindrical assemblies. The meat to be portioned may be urged downwardly into contact with the depth stop by means such as a ram in addition to the force of gravity.

Although described above with reference to primal cuts of meat, the invention may be used for portioning similar comestible articles, such as frozen bodies of hamburger mixture.

I claim:

1. Apparatus for portioning meat, comprising in combination a bandsaw arranged with a horizontal cutting flight, first and second meat holders positioned above said flight for rotation about a vertical axis, each meat holder being adapted to hold meat to be portioned substantially vertically at a position spaced from said axis, a respective drive means for rotating each meat holder about said axis, a respective depth stop associated with each meat holder below said flight whereby the meat to be portioned is fed across said flight while resting on the depth stop by rotation of the meat holder, and a cover selectively positionable so as to cover one of said meat holders at a time, said cover comprising (1) a slidable inverted channel section member positionable so as to cover one of the said meat holders at a time, (2) first end plate means at one end of the apparatus which cooperates with the selectively positionable channel section member when the latter is at one end of its travel to form therewith a protective cover for the meat holder adjacent the said first end plate means, and (3) second end plate means located at the opposite end of the apparatus which co-operate with the selectively positionable channel section member to form a protective cover for the other meat holder at the opposite end of the apparatus when the channel section member has been moved to that end of the apparatus.

2. Apparatus as set forth in claim 1 in which said channel section member includes a panel which is accessible from that side of the apparatus which contains switch means for controlling operation of the apparatus, said panel including a hand grip to permit said channel section member to be moved from covering one of said meat holders to cover the other of said meat holders without the operator having to reach over the apparatus.

3. Apparatus as set forth in claim 1 wherein the bandsaw is totally enclosed except for an aperture beneath the meat holders and above the depth stops.

4. Apparatus as set forth in claim 1 wherein each meat holder is adapted to hold a plurality of pieces of meat to be portioned at spaced circumferential locations.

5. Apparatus as set forth in claim 4 wherein each meat holder comprises an upright cylindrical assembly having a central hub portion, a plurality of radial planar walls and circumferential wings each extending from an outer end of a respective radial wall part way towards an adjacent radial wall.

* * * * *